US006158753A

United States Patent [19]

Sturbaum

[11] Patent Number: 6,158,753

[45] Date of Patent: Dec. 12, 2000

[54] SKATEBOARD HAVING INDEPENDENT TANDEM WHEELS

[76] Inventor: Kurt H. Sturbaum, 87 Hyde Ct., Bedminster, N.J. 07921

[21] Appl. No.: 09/439,483

[22] Filed: Nov. 15, 1999

Related U.S. Application Data

[63] Continuation-in-part of application No. 08/934,440, Sep. 19, 1997, abandoned, which is a continuation-in-part of application No. 08/719,128, Sep. 24, 1996, abandoned.

[51] Int. Cl.[7] ..... A63C 17/02

[52] U.S. Cl. ..... 280/87.042; 280/11.225; 280/11.233; 280/11.28

[58] Field of Search ..... 280/87.041, 87.042, 280/11.223, 11.225, 11.233, 11.27, 11.28, 676, 842

[56] References Cited

U.S. PATENT DOCUMENTS

| | | | |
|---|---|---|---|
| 1,975,905 | 10/1934 | Specht | 280/11.22 |
| 4,062,557 | 12/1977 | Roden | 280/87.042 |
| 4,272,090 | 6/1981 | Wheat | 280/11.28 X |
| 4,337,961 | 7/1982 | Covert et al. | 280/87.042 |
| 4,382,605 | 5/1983 | Hegna | 280/11.22 |
| 5,052,702 | 10/1991 | Chan | 280/11.28 |
| 5,092,614 | 3/1992 | Malewicz | 280/11.22 |
| 5,135,244 | 8/1992 | Allison | 280/11.22 X |
| 5,342,071 | 8/1994 | Soo | 280/11.22 |

*Primary Examiner*—Michael Mar
*Attorney, Agent, or Firm*—Roger M. Rathbun

[57] ABSTRACT

A skateboard having independently pivotally mounted trucks affixed to the skateboard axle on the underside of the footboard. Each of the trucks has a pair of wheels that are rounded or tapered in the direction toward the surface on which the skateboard is used to approach a point contact with the surface. Due to the independent suspension of each truck, in the event one of the wheels of one truck encounters an obstacle, that wheel can raise upwardly to ride over the obstruction while all of the other wheels can remain in contact with the surface. As such there is a stable ride even when riding over obstacles and the contour or profile of the wheels tends to also promote a stable ride since the wheel profile tends to push small obstacles away rather than riding over the obstacle.

11 Claims, 3 Drawing Sheets

SKATEBOARD HAVING INDEPENDENT TANDEM WHEELS

REFERENCE TO RELATED APPLICATIONS

The present patent application is a continuation-in-part of U.S. Ser. No. 08/934,440, filed Sep. 9, 1997 now abandoned and which, in turn is a continuation in part of U.S. Ser. No. 08/719,128 filed Sep. 24, 1996 now abandoned.

BACKGROUND

The present invention relates to skateboards, and, more particularly, to an improved skateboard having a plurality of trucks, each of which support two narrow wheels, spaced apart and rotatably mounted thereto. Each truck is rotatably mounted to an axle of the skateboard such that each truck is free to rotate independent of any other truck that is employed with the skateboard.

There are, of course, considerable number of skateboards currently in use and which, in general, comprise a footboard on which the user rides and has a pair of axles, a forward and a rearward axle depending upon the direction of travel, that are affixed to the underside of the footboard. The typical construction includes a rather wide, cylindrical wheel that is rotatably affixed to the outer ends of each of the axles. The typical axles are fixed in position to the footboard on which the rider is positioned and have opposite ends extending laterally outwardly with respect to the longitudinal axis of the skateboard. The wide wheels, in turn are also fixed with respect to the footboard and, as such, the wheels do not individually give or move as the skateboard encounters an obstruction such as a bump or crevice. Thus, a bump or obstruction can cause a problem in the performance of the skateboard and may, at times, stop the travel of that skateboard to the distress of the user.

There have been examples of skateboards having differing systems to alleviate the problems of encountering bumps or obstructions in the use of the device, and one such example is shown and described in U.S. Pat. No. 4,062,557 of Roden where there are front and rear trucks, each having four wide wheels and where the two trucks are allowed to pivot to a limited degree due to the means with which each of the trucks is affixed to the footboard. As can be seen in the Roden reference, both trucks themselves itself pivot each time any one of the wheels encounters an obstruction to enable the wheel hitting the obstruction to be raised to travel over the obstruction. However, at the same time, the other corresponding lateral wheel affixed to that same truck also moves upwardly along with the wheel hitting the obstruction. Thus, the other wheel that has not hit anything is unduly raised off of the surface on which the skateboard is moving and the skateboard is therefore unnecessarily compromised in its stability with respect to the ground. It would obviously be better if only the wheel that encounters the small bump be raised to travel over that bump and not affect the operation of other wheels and their contact with the ground, i.e. that the laterally spaced wheels operate independently with respect to each other. In addition, with the use of the wide wheels of Roden, the chance of encountering such small bumps increases and the wide wheels, having high compression shear, tend to try to pass over the bumps as opposed to pushing small obstructions, such as pebbles, aside and out of the way of the wheel.

Another example of a purported solution to the difficulties of encountering small bumps or obstructions in the operation of skateboards is shown and described in U.S. Pat. No. 4,337,961 of Covert et al, where the skateboard utilizes four trucks, each independently pivotally mounted for support of the footboard, however, in the Covert et al skateboard, there is used an endless belt that encircles each longitudinally spaced pair of wheels of each truck. The endless belt is mounted over wide wheels and contact with the ground is by means of the endless belt.

While, therefore, the individual, lateral sets of wheels are thus individually pivotable from their opposite spaced counterparts on any truck, the use of an endless belt itself creates a further problem. Skateboards are used in a rather rigorous environment and encounter a wide variety of maneuvers, among the most basic of which, are turns, some of which are quite sharp and deliberately aggravated. As such, when the skateboard is turned in direction by the user, the skateboard, bearing the weight of the user is forced outwardly by considerable centrifugal force and creates high lateral stresses on the wheels.

The use of an endless belt, therefore, would tend to be stressed laterally and would be forced off of the wheels in such a turn. In such case, obviously, the endless belt is highly susceptible to coming off the wheel and which is certainly an undesirable characteristic of such a skateboard. As a solution, it would be necessary to apply considerable tension to tighten the belt around the wheels to try to hold the belt on to the wheel during turns, however, that only creates the further problem that any debris that would be swept up by the endless belt would become lodged between the interior surface of the belt and the wheels and would cause considerable problems, either by stopping the belt and wheel movement or causing damage to the endless belt. Again, also, as in the Covert et al construction, the use of a wide belt raises the likelihood that the belt will try to travel over obstructions rather that to push them aside.

SUMMARY OF THE INVENTION

The present invention provides an improved skateboard having improved properties concerning the ability to maneuver over obstructions, such as pebbles and the like.

In the present invention, the skateboard itself comprises the normal footboard and axles affixed to the underside surface of that footboard. To the extending ends of both of the axles, however, there is pivotally affixed, a truck that carries and supports two spaced apart wheels. As is preferred, the wheels are not of a wide, flat construction but are narrow, round ed wheels that are tapered or rounded downwardly so as to touch the ground at a relatively thin profile. By the particular configuration of the wheel profile, as one feature of the present invention, in the event the wheel rolls over a stone or other small obstruction, the shape of the wheel tends to push that obstruction outwardly so that the wheel avoids that impediment rather than having to roll over the object. In addition, the narrow wheels of the present invention are of a flexible material such that the wheels flex or distort to absorb the impact of a obstruction.

In addition, as a further feature of the present invention, each of the trucks is individually rotatable about an axle, that is, each wheel and truck is independent of the movement of any other truck such that such that in the event any one wheel encounters an obstruction, that wheel can move upwards as its truck rotates or pivots about the axle, however, the remaining tracks are unaffected by the pivoting of that one truck and those other trucks do not pivot. Thus, the wheels carried by those other trucks, stay in full contact with the ground or other surface so that the skateboard doesn't sacrifice any stability as all of the wheels continue to bear the load.

As described herein, the affixation of the trucks to an axle will be de scribed alternately as pivotally and rotatably, it being that each truck can rotate fully 360 degrees about its axle and which feature is convenient to change the prelative positions of the wheels affixed to that axle, that is, the front and rear wheel of any truck can be reversed by rotating that truck 180 degrees and which allows the wheels to be reversed to allow the wheels to wear evenly or to change from one front wheel to another wheel having a different durometer to account for different conditions of the terrain to be encountered by the skateboard in use. In normal operation, however, while rotatable affixed to the axle, the wheels will simply individually pivot or rotate a more limited amount as the skateboard travels over the terrain.

In the preferred embodiment of the present invention, each truck is comprised of a pair of support members that are affixed together to retain the wheels between the two support members. Thus, each wheel is fully supported and contained between the support members for strength in the construction. Each of the support members are also preferable identical, such that in the manufacturing of the trucks, each support member can be identically molded and secured together. In securing the two support members together, there is a keying system employed to prevent the two support members, once joined, from twisting out of alignment. To accomplish that keying, the identical support members each has an indentation and a projection being sized such that the projection fits snugly into the indentation. In the manufacture, therefore, the support members fit together and are keyed to prevent twisting but have the further cost advantage that each support member can be identically molded.

Other features of the present skateboard and truck for a skateboard will become apparent in light of the following detailed description of a preferred embodiment thereof and as illustrated in the accompanying drawings.

DETAILED DESCRIPTION OF THE INVENTION

Figure 1:
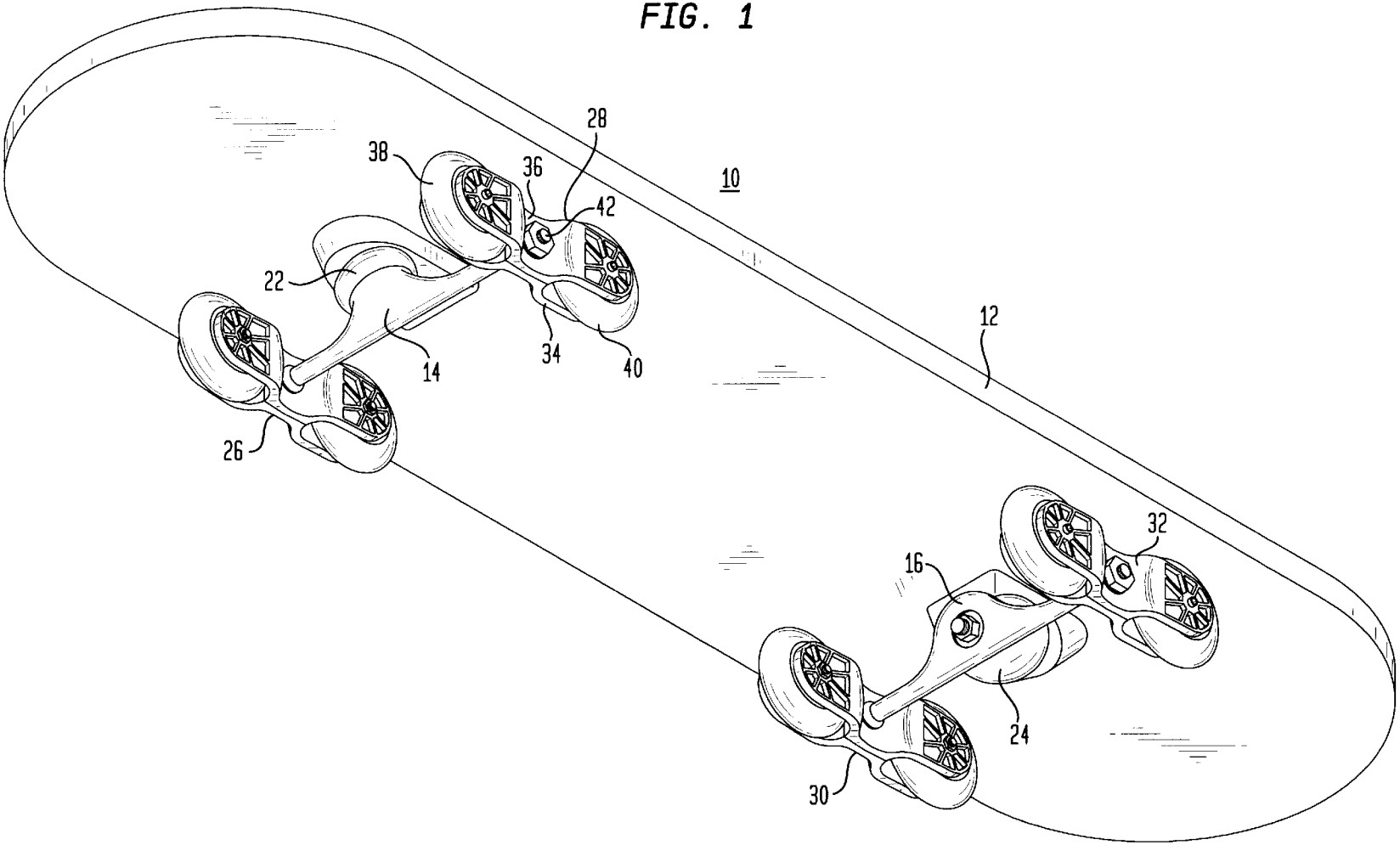
FIG. 1 is a perspective view of the underside of a skateboard showing the trucks constructed in accordance with the present invention.

Referring now to FIG. 1, there is shown a perspective view showing the underside of a skateboard 10. The typical components of a skateboard include a footboard 12 and a pair of axles 14, 16 that are affixed to the underside of the footboard 12. The axles 14,16 may be affixed to the footboard 12 by conventional means such as nuts, (only nut 18 is shown in FIG. 1) threadedly engaged to a suitable threaded free end of a cushioning device or shock absorber 22, 24. As will be seen, the present invention can be produced through the use of a conventional skateboard having the aforedescribed axles and thus retrofitted to skateboards currently in use to arrive at the features and advantages of the present invention. Alternatively, of course, the skateboard 10 of the present invention can be constructed totally by a manufacturer.

In conventional skateboards, and as shown in the FIG. 1, the axles 14, 16 extent laterally outwardly with respect to the longitudinal axis of the footboard 12 and have ends on which trucks 26, 28, 30 and 32 are located. In view of the fact that preferably all of the trucks are identical, only one will hereinafter be described. The truck 28 comprises two support members 34, 36 and which are placed in juxtaposition with respect to each other as will later be explained, and wheels 38, 40 are held and rotatably supported between the two support members 34,36, thus holding the wheels 38, 40 and providing good support for the wheels 38,40. Again, since the ends of the normal axles for conventional skateboards have threaded ends, the truck 28, as well as the other three trucks, can be affixed to the axle 14 by means of a nut 42.

As one of the features of the present invention illustrated in FIG. 1, the profile of the wheels 38 and 40 is a rounded configuration that is rounded or tapered inwardly in the direction to where the wheel 38, 40 contacts the surface on which the skateboard 10 is being employed. Thus, rather than the basically line contact with the surface as in the case of conventional wide, cylindrical skateboard wheels, the wheels of the present invention contact the supporting surface at an approximate point contact. Also, the flexibility of the narrow wheels allow the wheel to flex or distort to absorb the impact of obstructions as the skateboard is used.

Figure 2:
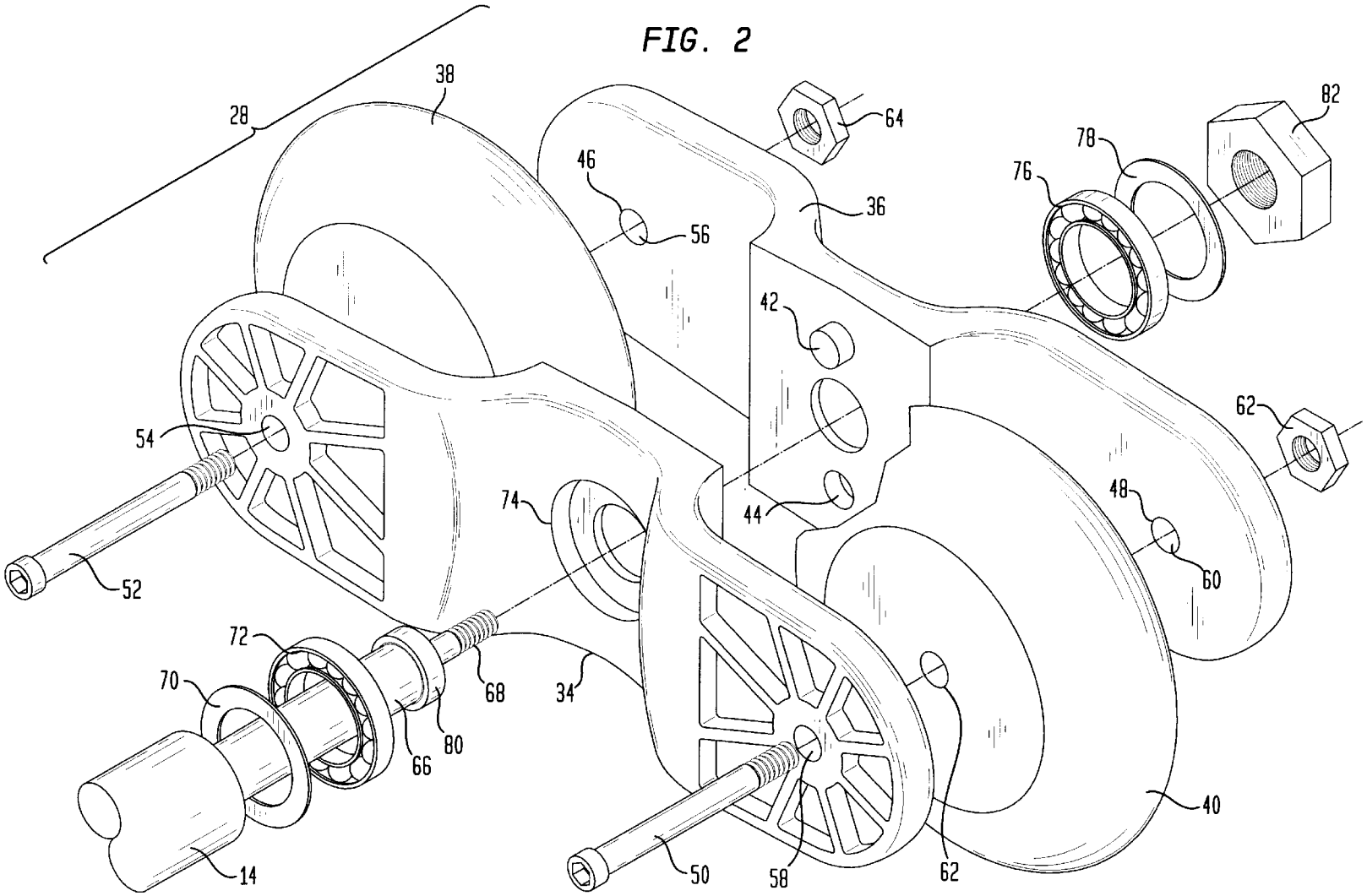
FIG. 2 is an exploded view of the skateboard of the present invention.

Turning now to FIG. 2, there is shown an exploded view of a truck 28 for mounting upon the axle 14. In the Fig., there can be seen the two support members 34 and 36 and that they are, in the preferred embodiment, identical and can be produced in a molding process so that both support members 34, 36 can use the same mold in the production thereof. In order to interlock the two supporting members 34 and 36, a keying system can be used and, as preferred, that keying system is accomplished by the use of a projection 42 and an indentation 44 on each of the support members 34, 36 (only one of each being visible in FIG. 2).

Thus, in the assembly of the truck 28, the identical support members 34, 36 interlock together by the projection of one being inserted into the indentation of the other and vice versa. The end combination has the keying accomplished by a projection of each support member being snugly interfitted within an indentation of the other support member. Obviously, as the support members 34, 36 are identically molded, one will be inverted 180 degrees to allow the interfitting to take place. Once interfitted together, however, the support members are keyed and they do not twist with respect to each other.

Bosses 46, 48 are formed on the interior surface of the support members 34, 36 so that the wheels 38, 40 will rotate freely and not rub against the interior surfaces of the support members 34, 36.

As shown, the wheels 38, 40 are sandwiched between the support members 34, 36 and are rotatably supported and carried by the support members 34, 36 by means of bolts 50, 52 inserted through holes 54, 56, 58 and 60 of the support members 34, 36 and through a hole 62 (only one of which is shown in FIG. 2) formed in each of the wheels 38, 40. The bolts 50 and 52 each are threaded so as to receive nuts 62 and 64 to secure the wheels 38, 40. By this arrangement, the wheels 38,40 are fully supported on both sides thereof and results in a strong support and resistant of loosening and breakage.

Accordingly, once the truck 28 has been assembled it can be easily be installed to the end of the axle 14 which may be, as explained, a standard axle currently used on many skateboards. That typical axle 14 has an extended shaft 66 having a threaded end 68. A washer 70 and ball bearing 72 are fitted over the extended shaft 66 and which fit into a circular recess 74 formed in the center of each of the support members 34, 36. The same assembly takes place on the opposite side, or outer side, of the support members 34, 36 by means of a further ball bearing 76 and washer 78. A spacer 80 is positioned between the ball bearings 72 and 76 to provide a finite space between those components. Thus, the final assembly is completed by affixing a nut 82 on the threaded end 68 of the extended shaft 66 to assemble the truck 28 to the axle 14.

Therefore, as assembled, the truck 26 is rotatably mounted to the axle 14 by the ball bearings 72 and 76 so that truck 28, as well as the other three trucks, each can pivot as one of the wheels of any of the trucks encounter an obstacle such as a small stone or other obstruction. Again, as explained, during the normal operation of the skateboard 10, the truck 28 pivots or rotates only a limited amount depending on the terrain and the particular obstruction, however, it is possible to rotate the truck 180 degrees about the axle 14 by the user so that the front and rear wheels can be reversed at any time desired by the user. Such reversal of front and rear wheels can be undertaken from time to time to create a more even wear of the wheels since the front wheel will generally wear more rapidly than the rear wheel on any particular truck 28. Alternatively, the user may have a front and rear wheel of differing durometer and thus can readily change the durometer of the front wheel to account for a change in terrain and the need to have the front wheel of a durometer that is best suited to such terrain.

Figure 3:
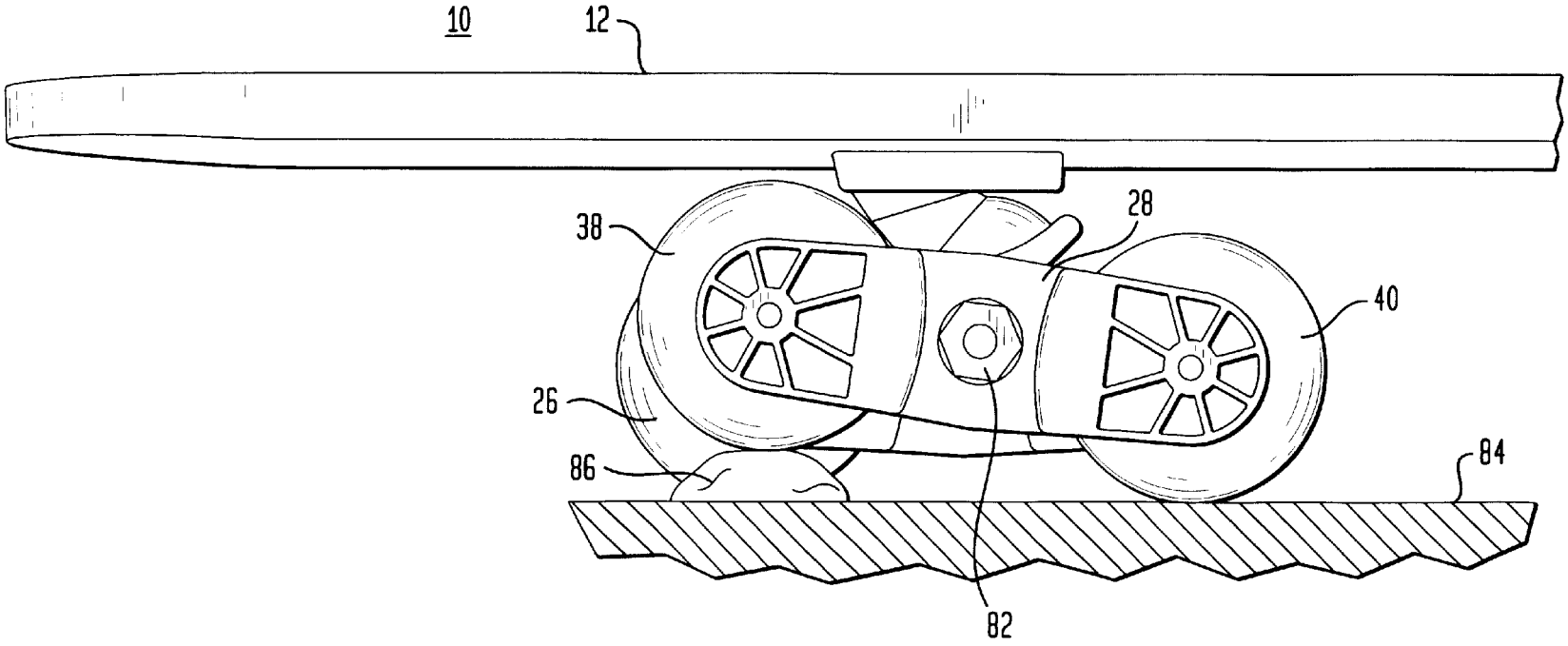
FIG. 3 is a side view depicting the operation of the skateboard of the present invention.

Turning now to FIG. 3, there is shown a side view of a skateboard 10 and showing the specific truck 28 that was explained with reference to FIG. 2. In the Fig. the footboard 12 is moving to the left over a surface 84 and is shown encountering an obstruction 86. Thus, the wheel 38 raises vertically with respect to the surface 84 to clear the obstruction 86 and causes the truck 28 to pivot, raising one end of the truck 28. On the far side of the skateboard 10, however, the truck 26 can be seen in its normal level position and does not pivot as does the truck 28. As seen, therefore, each truck is independently pivotable about the axle so that when one wheel is raised to pass over an obstruction, the remaining wheels remain on the surface on which the skateboard 10 is traveling.

It will be understood that the scope of the invention is not limited to the particular embodiment disclosed herein, by way of example, but only by the scope of the appended claims.

I claim:

1. A skateboard for recreational movement over a surface, said skateboard comprising: a footboard, at least front and rear steerable axle assemblies mounted to an undersuface of said footboard with each axle assembly having an axle with laterally spaced end portions extending therefrom, and a pair of trucks pivotally mounted to respective end portions of each said axle, each truck of said pair of trucks including a pair of separable support members for rotatably supporting a pair of wheels, each pair of support members having central portions configured to be in an abutting, interlocking relationship when the pair of support members are affixed together to form a truck, each pair of support members when affixed together having an opening extending through the central portions for pivotally receiving therethrough the end portion of a respective axle, and each pair of support members having a pair of longitudinally spaced end portions with each end portion having a lateral separation therebetween when the support members are affixed together for rotatably supporting a respective wheel therebetween.

2. A skateboard for recreational movement over a surface as defined in claim 1 wherein each of said trucks is rotatable 180 degrees about said axle.

3. A skateboard for recreational movement over a surface as defined in claim 1 wherein said pair of support members comprise identical support members keyed together to cause each of said identical support members to move together without twisting with respect to each other.

4. A skateboard for recreational movement over a surface as defined in claim 3 wherein said identical support members are molded plastic support members, each having a projection and a indentation, said projection of one of said support members interfitting within said indentation of said other support member.

5. A wheel assembly for use with a skateboard having a footboard and at least one steerable axle assembly mounted to an undersuface of said footboard, each steerable axle assembly having a pivoting axle with laterally spaced end portions extending therefrom, said wheel assembly being configured for use as a pair of wheel assemblies for attachment to a respective steerable axle assembly, said wheel assembly comprising: a truck pivotally mounted to a respective end portion of said axle, said truck including a pair of separable support members for rotatably supporting a pair of narrow wheels, the pair of support members having a central portion configured to be in an abutting, interlocking relationship when the pair of support members are affixed together to form a truck, the pair of support members when affixed together having an opening extending through the central portions for pivotally receiving therethrough a respective end portion of said axle, and the pair of support members having a pair of longitudinally spaced end portions with each end portion having a lateral separation therebetween when the support members are affixed together for rotatably supporting a respective wheel therebetween.

6. A wheel assembly as defined in claim 3 wherein said narrow wheels are tapered inwardly.

7. A wheel assembly as defined in claim 5 further comprising bearing means centrally positioned in said truck to allow the pivoting of said wheel assembly with respect to the axle.

8. A wheel assembly as defined in claim 7 wherein said bearing means is a ball bearing.

9. A wheel assembly as defined in claim 5 herein said two support members are identically molded members interlocked together to prevent twisting with respect to each other.

10. A wheel assembly as defined in claim 9 wherein said two support members each have a projection and an indentation and said interlocking together comprises the interfitting of said projection of one support member in the indentation of said other support member.

11. A wheel assembly as defined in claim 10 wherein said wheels have an arcuate profile to contact a supporting surface at approximately a point contact.

* * * * *